United States Patent [19]

Yamashita et al.

[11] 4,245,992

[45] Jan. 20, 1981

[54] DISCHARGE PRINTING PROCESS FOR CELLULOSIC FABRICS USING A QUATERNARY AMINE POLYMER

[75] Inventors: Yasuo Yamashita, Kyoto; Masami Ikeyama, Youkaichi; Takao Nishikawa, Takatsuki, all of Japan

[73] Assignee: Toray Industries, Inc., Tokyo, Japan

[21] Appl. No.: 98,525

[22] Filed: Nov. 29, 1979

[30] Foreign Application Priority Data

Dec. 1, 1978 [JP] Japan ..... 53-147829

[51] Int. Cl.[3] ..... D06P 3/82; D06M 13/34

[52] U.S. Cl. ..... 8/461; 8/188; 8/552; 8/602

[58] Field of Search ..... 8/21 C, 172 R, 69, 188, 8/54.2

[56] References Cited

U.S. PATENT DOCUMENTS

| | | | |
|---|---|---|---|
| 3,619,356 | 9/1971 | Keen | 8/7 |
| 3,619,357 | 9/1971 | Keen | 8/7 |
| 3,788,804 | 1/1974 | Harper et al. | 8/18 |
| 3,807,946 | 4/1974 | Harper et al. | 8/18 |
| 4,113,674 | 9/1978 | Miller et al. | 8/31 |

FOREIGN PATENT DOCUMENTS

| | | |
|---|---|---|
| 855699 | 12/1977 | Belgium . |
| 49-80379 | 8/1974 | Japan . |
| 5335016 | 9/1976 | Japan . |
| 52-59786 | 5/1977 | Japan . |
| 52-70196 | 6/1977 | Japan . |
| 1055899 | 1/1967 | United Kingdom . |

OTHER PUBLICATIONS

Gangneux, A. et al., Eur. Polymer Journal, 1976, 12, (No. 8), pp. 543–549, 551–557.

*Primary Examiner*—A. Lionel Clingman

*Attorney, Agent, or Firm*—Miller & Prestia

[57] ABSTRACT

A fabric of cellulosic fibers, particularly natural cellulosic fibers, of improved dyeability having a polymer of a monomer containing a quarternary amine group dispersed in the fibers with no phase separation is discharge printed. The improved cellulosic fibers can be prepared by impregnating a monomer containing a quarternary amine group into cellulosic fibers and polymerizing the monomer in the fibers. This treatment of cellulosic fibers with the polymer of a quarternary amine monomer can be advantageously utilized in the discharge printing of a fabric from a blend of hydrophobic synthetic/cellulosic fibers.

9 Claims, 4 Drawing Figures

DISCHARGE PRINTING PROCESS FOR CELLULOSIC FABRICS USING A QUATERNARY AMINE POLYMER

BACKGROUND OF THE INVENTION

1. Field of the Invention

The invention relates to cellulosic fibers of an improved dyeability and their production and use. More particularly, the invention relates to cellulosic fibers having an improved dyeability with an anionic dye, in which fibers a monomer containing a quarternary nitrogen atom is polymerized, as well as to a process for the production thereof and a process for discharge printing them.

2. Description of Prior Art

Cellulosic fibers are generally dyed with direct dyes or reactive dyes. These dyes have in general a low affinity and, thus, it is necessary to use an inorganic salt in a dyebath. However, even in the case where an inorganic salt is used, if a deep dyeing is to be obtained, a fair amount of the dye is retained in the dyebath which causes problems regarding environmental pollution and economy. Furthermore, direct dyes have a drawback in that they are inferior in wet fastness.

In the color discharge printing of cellulosic fibers, a vat dye or pigment is generally used as the effect color of printing to be added to the discharge printing paste. However, the use of vat dyes or pigments causes the following problems. When a vat dye is employed as the effect color of printing, sodium formaldehyde sulfoxylate, which is usually employed as a reducing agent, is unstable and, thus, its reducing capacity is decreased after the paste is applied to the material to be printed, thereby making the printing technically difficult and also making the acquisition of a clear color print difficult. When a pigment is employed, the resulting printings are liable to have a hard hand and a paint-like color shade, which degrade the quality of the resulting products. In particular, in the color discharge printing of textile materials of synthetic fiber/cellulosic fiber blends, the vat dyes which are built up in an alkaline medium can not be used as the effect color of printing in combination with dyes of the other classes and, thus, it is practically impossible to obtain a color discharge print on such blend materials.

Methods of treating cellulosic fiber materials with a quarternary ammonium group-containing polymer have hitherto been known, for example, in Japanese Patent Publications Nos. 53-23437, 53-24551 and 53-24552 and Japanese Laid-open Patent Specification No. 52-70196. In these methods, a film of the polymer is formed on the fiber surface. The treated materials have a hard hand and, in addition, cannot produce dyeings having a satisfactory color fastness since the dyeing sites applied by the treatment are easily fallen off by washing or rubbing.

On the other hand, methods of spinning a blend of a viscose solution and a quarternary ammonium group-containing polymer have been known, for example, in Japanese Laid-open Patent Specifications Nos. 53-35016, 53-35017 and 53-35018. However, these methods cannot be applied to natural cellulosic fibers.

SUMMARY OF THE INVENTION

We have made an intensive study regarding cellulosic fibers which are dyeable with acid dyes and can produce dyeings having excellent color fastness and have thus achieved the present invention. The present invention has the following construction.

(1) A process for discharge printing a fabric of natural cellulosic fibers, comprising subjecting the fabric of natural cellulosic fibers having a polymer of a monomer containing a quarternary amine group dispersed therein with no phase separation to discharge printing.

(2) A process for discharge printing a fabric of cellulosic fibers, which comprises, in advance of the discharge printing, impregnating a monomer containing a quarternary amine group into a cellulosic fiber and polymerizing the monomer in the fiber.

(3) A process for discharge printing a fabric of a blend of synthetic fibers dyeable with an anionic or disperse dye and cellulosic fibers, which comprises impregnating a monomer containing a quarternary amine group into the fabric, polymerizing the monomer in the fabric and, then, subjecting the fabric to discharge printing.

DESCRIPTION OF PREFERRED EMBODIMENTS

Figure 1:
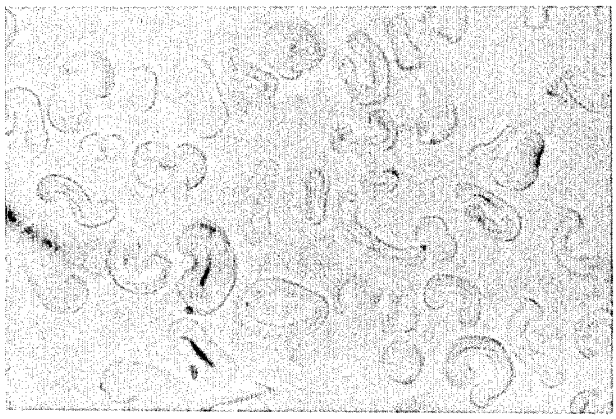

The present invention will be described below in detail.

The monomer containing a quarternary amine group (hereinafter, referred to as "quarternary amine monomer" for brevity) is preferably an addition polymerizable monomer which includes, for example, the following compounds.

2-Hydroxy-3-methacryloxypropyl-trimethylammonium chloride:

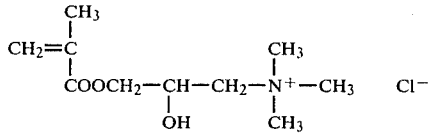

2-Methacryloxyethyl-trimethylammonium chloride:

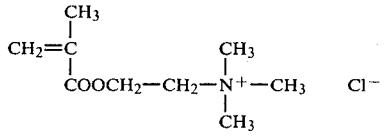

p-Vinyl-benzyl-trimethylammonium chloride:

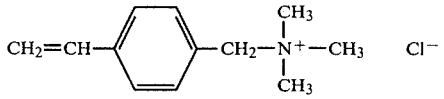

Dimethyldiallylammonium chloride:

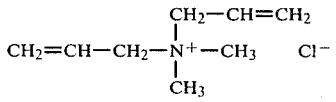

These monomers, which have a quarternary amine group and an addition polymerizable double bond, have a high affinity for cellulose and act as a swelling agent of cellulosic fibers. Thus, they are dispersed in the cellulosic fibers in the monomolecular form and are easily addition polymerized in the cellulosic fibers to form cellulosic fibers having a polymer of such a monomer uniformly dispersed therein.

The expression that a polymer is uniformly dispersed in a fiber, as used herein, is intended to mean that the cellulose phase and the phase of the polymer of the quarternary amine monomer present in the fiber are optically indistinguishable. In such a state, both polymers are bonded to each other with high affinity and, thus, the polymer of the quarternary amine monomer cannot be fallen off from the fiber by treatments such as dyeing, rinsing, dry cleaning and the like.

In the production of cellulosic fibers of improved dyeability, it is preferable that an aqueous solution of a quarternary amine monomer with a polymerization initiator added be impregnated into a textile material consisting of or comprising cellulosic fibers, the quarternary amine monomer be polymerized by heating the impregnated textile material, and thereafter, the textile material be rinsed and dried. The heating may preferably be carried out in saturated steam at 80° to 140° C. for 30 sec. to 30 min. However, in the case where the above process is carried out continuously, it is desirable to carry out the heating for about 1 to 5 min. The heating for the polymerization of the quarternary amine monomer may also be carried out in dry air at 100° to 180° C. or in high temperature steam at 105° to 130° C. However, in the case of the heating in dry air, yellowing of the material may occur and the polymerization efficiency may be inferior.

It is preferable that the quarternary amine groups be introduced into the cellulosic fibers in an amount of 10 to 800 milliequivalents/kg of fibers. If the amount of the quarternary amine groups is less than 10 milliequivalents/kg of fibers, it may be difficult to obtain cellulosic fibers having substantial dyeability with anionic dyes by ionic bonding. If the amount of the quarternary amine groups is more than 800 milliequivalents/kg of fibers, strength reduction and yellowing of the cellulosic fibers may undesirably occur. It is particularly preferable, in the point of view of resulting desirable dyeability, low yellowing and soft hand, that the quarternary amine groups be introduced into the cellulosic fibers in an amount of 50 to 400 milliequivalents/kg of fibers. If a textile material of a blend of cellulosic fibers and the other fibers is to be treated, the amount of the quarternary amine groups present in the cellulosic fibers should be in the above-mentioned scope.

The equivalent amount of the quarternary amine groups which are present in the treated cellulosic fibers and act as dyeing sites for anionic dyes may be measured as follows.

The treated cellulosic fiber material is dyed, using an aqueous dyebath containing 0.1% by weight of Acid Orange II (C.I. Acid Orange 7, pure form) and 1 g/l of acetic acid (90%), at 98° C. for 6 hours with 1000:1 liquor ratio. Then, the degree of exhaustion (%, represented by Ex) is determined by the colorimetry of the dyebath after the dyeing and the equivalent amount of the quarternary amine groups is calculated by the following equation: Equivalent amount of quarternary amine groups $$(\text{milliequivalents/kg of fibers}) = \frac{100 \times E_x}{35}.$$

Upon the polymerization of the quarternary amine monomer in the cellulosic fibers, the quarternary amine monomer may be copolymerized with a copolymerizable comonomer such as acrylamide or the like.

As the polymerization initiator, there may be employed ammonium persulfate, potassium persulfate, benzoyl peroxide, azobisisobutyronitrile and the like. Among these, ammonium persulfate and potassium persulfate, which are water soluble, are particularly preferred. If a quarternary amine monomer employed is fairly inferior in water solubility, the quarternary amine monomer may form a complex by the reaction with an anionic polymerization initiator. Thus, when such a quarternary amine monomer of fairly inferior water solubility is used, it is preferable to employ, as the polymerization initiator, 2,2'-azobis(2-amino-propane) hydrochloride, which is water soluble and cationic. It may be suitable that the polymerization initiator be used in an amount of 0.01 to 10 g/l. However, from the point of view of the stability of the quarternary amine monomer solution to be impregnated, it is desirable that the initiator be used in an amount of 1 to 5 g/l. The textile material to be treated may be in any form such as a loose fiber, yarn, or knitted, woven or non-woven fabric form.

The reason why the quarternary amine monomer can be polymerized in the cellulosic fibers is not clearly known. However, it is supposed that the quarternary amine monomer acts as a swelling agent to the cellulosic fibers (see, for example, American Dyestuff Reporter, 55, 407 (1966)) and, thus, can easily penetrate into the amorphous region in the inside of the cellulosic fibers. Also, dyes can easily diffuse into the inside of the treated cellulosic fibers. Furthermore, since the polymerization does not occur between the fibers, the treated fibers do not become hard.

As is seen from the comparative example given hereinafter, an acrylate monomer having an acidic group such as a sodium sulfonate group can also be polymerized in cellulosic fibers and, thus, the treated cellulosic fibers can be dyed with cationic dyes. However, a major part of the dye is removed from the dyed fibers by washing and color fastness to light of the dyed fibers is extremely poor.

The quarternary amine monomers useful for the present invention are generally highly water soluble and cannot penetrate into hydrophobic synthetic fibers so that they are not polymerized in the synthetic fibers. That is to say, in the case of cellulosic/hydrophobic synthetic fiber blend materials, the quarternary amine monomers are polymerized selectively in the cellulosic fibers to modify only the cellulosic fibers.

The cellulosic fibers typically include cotton, ramie, linen, jute and kemp fibers. The synthetic/natural cellulosic fiber blend materials to which the present invention can be advantageously applied, are, for example, polyester/cotton blends, polyester/ramie blends, nylon/cotton blends, nylon/ramie blends, nylon/linen blends, acrylic dyeable with an acid dye/cotton blends, acrylic dyeable with an acid dye/ramie blends and acrylic dyeable with an acid dye/linen blends. The "blend material" as used herein is intended to include blended yarns, twisted union yarns and fabrics made therefrom as well as woven or knitted union fabrics and the like. Further, natural fiber blend materials such as cotton/wool blends, cotton/silk blends and the like can be used in the present invention. In these natural fiber blend materials, the quarternary amine monomer is polymerized only in the cellulosic fibers.

Further, it will be appreciated that the present invention can be applied to regenerated cellulose fibers such as viscose rayon and cupro-ammonium rayon fibers.

The present invention further provides a process for discharge printing the thus modified synthetic/cellulosic fiber blend fabrics. The synthetic fibers present in the blend fabrics usable for the discharge printing process according to the present invention include synthetic fibers dyeable with an anionic dye or disperse dye, such as polyester fibers, nylon fibers, acrylic fibers dyeable with an acid dye and the like.

The dyes for dyeing the ground in the discharge printing process may be one or more classes of the dyes selected from reactive dyes, direct dyes, naphthol dyes, acid dyes, 1:1 premetallized dyes and 1:2 premetallized dyes. Further, in the case of polyester/cellulosic fiber blend fabrics, in combination with any of the above-mentioned dyes, disperse dyes may be used for dyeing the polyester fibers.

The dyeing may be carried out in a conventional manner, for example, by means of a padding or exhaustion technique.

As the effect colors of printing in the case of color discharge printing where color effects are desired, there may be employed acid dyes and direct dyes. However, in the case of a polyester/cellulosic fiber blend fabric, in combination with the acid dyes or direct dyes, disperse dyes may be employed.

Reducing agents usable for the discharge printing include stannous chloride, Superlight SZ (zinc oxysulfoxylate formaldehyde, made by Mitsubishi Gas Kagaku K.K.) and Decroline Soluble Conc. (zinc sulfoxylate formaldehyde, made by BASF A.G.). However, in the case of color discharge printing, it is desirable, from the point of view of the stability of the dyes to be used, to employ stannous chloride which is a moderate reducing agent. Stannous chloride may preferably be employed in an amount of 5 to 15 parts by weight per 100 parts by weight of the printing paste. Further, in order to avoid the yellowing and/or embrittlement of the cellulosic fibers which may be caused by the action of hydrogen chloride evolved during the steaming of the fabric to which the printing paste is applied, it is preferable that urea in the same amount as the added stannous chloride also be added to the printing paste.

After applying the discharge printing paste to the fabric, the fabric may be steamed typically at about 100° to 110° C. for 30 to 60 minutes. However, in the case of polyester/cellulosic fiber blend fabrics, the steaming may advantageously be carried out at a temperature of 130° to 135° C.

According to the present invention, the following particular advantages can be obtained.

Cellulosic fibers can be dyed with acid dyes. In addition, where the cellulosic fibers are dyed with reactive dyes or direct dyes, the utilization of the dyes greatly increases.

Color discharge printing of hydrophobic synthetic/cellulosic fiber blend fabric can be carried out using acid dyes as the effect colors of printing so that printings having clear color shades can easily be obtained. Further, where stannous chloride is used as the reducing agent, high processability in the color discharge printing can be attained.

The invention will further be illustrated with reference to the following non-limitative examples. In the examples, color fastness to washing was determined according to JIS(Japanese Industrial Standard) L-0844, MC-2 method, color fastness to light was determined according to JIS L-1044 and washing fastness in color change was determined according to JIS L-0804. Further, the color development of the resulting dyeings was evaluated by L values (values designated in the uniform chromaticity scale system) determined by a degital color and color difference computer (made by Suga Kikai K.K., Japan).

EXAMPLE 1

A cotton lawn fabric was impregnated with an aqueous solution of 100 g/l of 2-hydroxy-3-methacryloxypropyltrimethylammonium chloride and 3 g/l of ammonium persulfate and uniformly squeezed on a mangle to a pick-up of 53%. The fabric was steamed at 100° C. for 5 minutes and, then, soaped at 60° C. for 15 minutes in water containing 1 g/l of Sandet G-900 (a nonionic surfactant based on polyoxyethylene, made by Sanyo Kasei K.K.) to remove the unreacted substances.

A sample of the treated fabric was dried in an oven at 100° C. for 2 hours and allowed to cool to room temperature in a desiccator filled with silicagel. The measurement of the weight of the sample showed a weight increase of 3.9%.

The treated fabric was then dyed with an aqueous dyebath containing 5% o.w.f. (on weight of fabric) of Kayanol Milling Black VLG (an acid dye of C.I. Acid Black 26, made by Nippon Kayaku K.K.) and 1% o.w.f. of acetic acid (90%), under the following conditions.

Heating-up time—30 minutes
Dyeing temperature—98° C.
Dyeing time—30 minutes
Liquor ratio—50:1

The fabric was then soaped at 60° C. for 20 minutes in water containing 1 g/l of Sandet G-900, rinsed and dried. Thus, a black dyed fabric having an L value of 16.7 was obtained.

After washing, the fabric had an L value of 16.1 and the color shade of the fabric was not changed. The dyed fabric had a light fastness of class 5.

Figure 2:
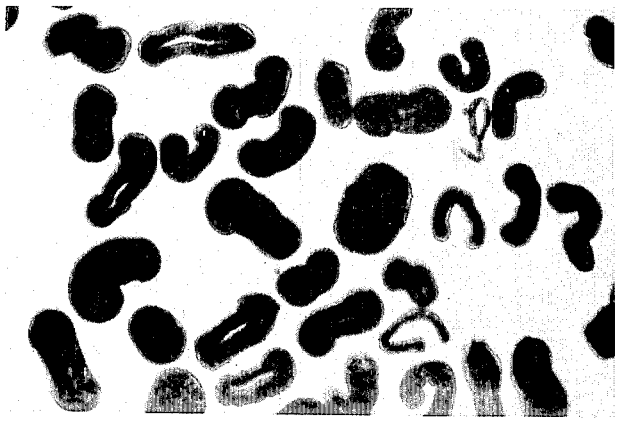

Two groups of cotton fibers, one of which was not subjected to the treatment with 2-hydroxy-3-methacryloxypropyl-trimethylammonium chloride as mentioned above and the other of which was subjected to the treatment, were dyed in the manner as mentioned above. A micrograph (×800) of the cross-sections of the fibers which were dyed without being subjected to the treatment is shown in FIG. 1 and a micrograph (×800) of the cross-section of the fibers which were subjected to the treatment and dyed is shown in FIG. 2. It is clearly observed that the treated fibers were uniformly dyed and there was found no phase separation between the two polymers in the treated fibers. This fact was also confirmed by the following examples.

Figure 3:
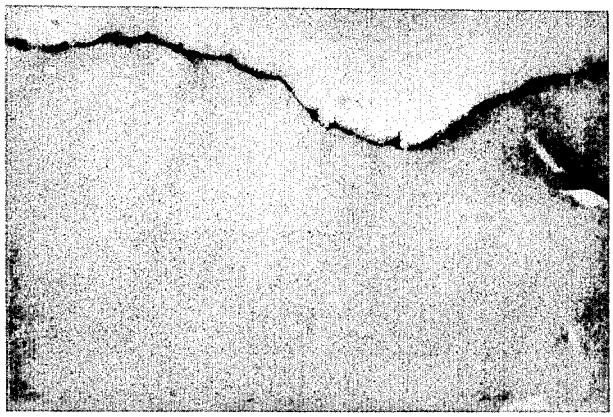
Figure 4:
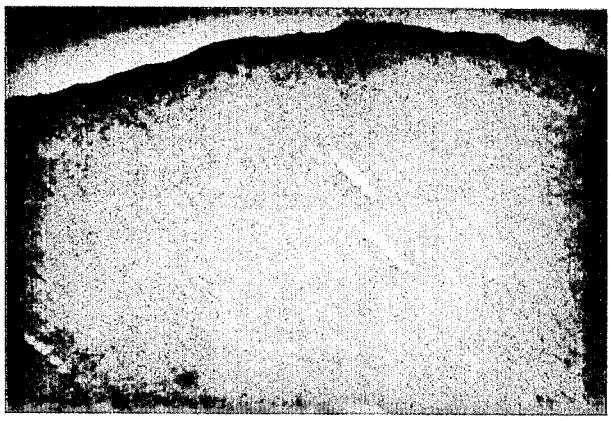

Further, the above-mentioned two groups of cotton fibers were dyed with osmic acid ($O_sO_4$) in a conventional manner (see, K. Katoh, Journal of Electromicroscopy, 14, No. 3, 1965). An electron micrograph (×20,000) of the cross-section of a fiber which was dyed without being subjected to the treatment is shown in FIG. 3 and an electron micrograph (×20,000) of the cross-section of a fiber which was dyed after being subjected to the treatment is shown in FIG. 4. In FIG. 4, it is observed that the polymer of the quarternary amine monomer which was dyed with $O_3O_4$ and deposited in the fiber is dispersed throughout the fiber cross-section as $O_3O_4$ particles having a particle diameter of not more than 300 Å.

COMPARATIVE EXAMPLE 1

A cotton lawn fabric as used in Example 1 was impregnated with an aqueous solution of 100 g/l of sodium sulfopropylmethacrylate and 3 g/l of ammonium persulfate and uniformly squeezed on a mangle to a pick-up of 55%. The fabric was steamed at 100° C. for 5 minutes and soaped at 60° C. for 15 minutes in water containing 1 g/l of Sandet G-900 to remove the unreacted substances.

A sample of the fabric was dried in an oven at 100° C. for 2 hours and allowed to cool to room temperature in a desiccator filled with silicagel. The measurement of the weight of the sample showed a weight increase of 2.8%.

The treated fabric was then dyed, with an aqueous dyebath containing 5% o.w.f. of Aizen Pure Blue 5GH (a cationic dye of C.I. Basic Blue 3, made by Hodogaya Kagaku K.K.) and adjusted to a pH value of 5 by the addition of acetic acid and sodium acetate, under the following conditions.

Heating-up time—30 minutes
Dyeing temperature—98° C.
Dyeing time—30 minutes
Liquor ratio—50:1

The fabric was then soaped at 60° C. for 20 minutes in water containing 1 g/l of Sandet G-900, washed with water and dried. Thus, a blue dyed fabric having an L value of 25.6 was obtained.

After washing, the fabric had an L value of 45.8, which proved that the fabric was almost completely decolored by the washing. The dyed fabric had a light fastness lower than class 2.

EXAMPLE 2

A cotton shirting fabric was impregnated with an aqueous solution of 100 g/l of p-vinyl-benzyl-trimethylammonium chloride and 0.5 g/l of potassium persulfate and uniformly squeezed on a mangle to a pick-up of 60%. The fabric was steamed at 105° C. for 3 minutes and soaped at 60° C. for 15 minutes in water containing 1 g/l of Sandet G-900 to remove the unreacted substances.

A sample of the treated fabric was dried in an oven at 100° C. for 2 hours and allowed to cool to room temperature in a desiccator filled with silicagel. The weight increase of the fabric was 3.2%.

The treated fabric was then dyed with an aqueous dyebath containing 10% o.w.f. of Remazol Black B (a reactive dye of C.I. Reactive Black 5, made by Hoechst A.G.), 5 g/l of soda ash, 1 cc/l of caustic soda (48° Bé) and 50 g/l of sodium sulfate, under the following conditions.

Heating-up time—30 minutes
Dyeing temperature—60° C.
Dyeing time—60 minutes
Liquor ratio—20:1

The fabric was then soaped at 90° C. for 20 minutes in water containing 1 g/l of Sandet G-900, rinsed and dried. Thus, a black dyed fabric having an L value of 16.1 was obtained.

The dyed fabric was cut into two pieces. Then, one of the fabrics was printed with a color discharge printing paste and the other was printed with a white discharge printing paste. The compositions of the two printing pastes are shown below.

| | |
|---|---|
| Color discharge printing paste: | |
| Kayanol Milling Yellow 3GW (an acid dye of C.I. Acid Yellow 72, made by Nippon Kayaku K.K.) | 2 parts by weight |
| Stannous chloride | 10 parts by weight |
| Urea | 10 parts by weight |
| Meypro Gum NP (a 15% aqueous solution) (a thickening agent based on locust bean gum, made by Meypro Co. Ltd.) | 60 parts by weight |
| Water | 18 parts by weight |
| Total | 100 parts by weight |
| White discharge printing paste: | |
| Decroline Soluble Conc. | 20 parts by weight |
| Meypro Gum NP (a 15% aqueous solution) | 70 parts by weight |
| Water | 10 parts by weight |
| Total | 100 parts by weight |

The printed fabrics were dried at 80° C. for 10 minutes and, then, steamed at 100° C. for 20 minutes. The fabrics were then rinsed, soaped at 60° C. for 15 minutes in water containing 1 g/l of Sandet G-900, rinsed and dried. Thus, two printings respectively having clear yellow and white patterns on the black back grounds were obtained. The black area of the color discharge printed fabric had a light fastness of class 5 and the yellow area had a light fastness of class 2. The washing fastness was class 5 in color change in the black area and was class 3 in color change in the yellow area.

EXAMPLE 3

A broad fabric of a polyester/cotton (65/35) blend was padded to a pick-up of 55% using an aqueous solution of 150 g/l of 2-methacryloxyethyl-trimethylammonium chloride and 1 g/l of ammonium persulfate. The fabric was then steamed at 120° C. for 2 minutes and soaped at 60° C. for 20 minutes in water containing 1 g/l of Sandet G-900 to remove the unreacted substances.

The weight increase of the fabric measured as described in Example 1 was 2.1%.

The polyester fibers or cotton fibers of a sample of the fabric were dissolved to leave the cotton fibers or polyester fibers, and the obtained cotton fibers or polyester fibers were dyed using 1% o.w.f. of Kayanol Milling Blue GW (an acid dye of C.I. Acid Blue 127, made by Nippon Kayaku K.K.), at 98° C. for 30 minutes, with 50:1 liquor ratio. In this way, it was confirmed that the cotton fibers were well dyed while the polyester fibers were only scarcely dyed, and thus, the quarternary amine monomer was polymerized only in the cotton fibers.

Then, the treated polyester/cotton blend broad fabric was dyed, using an aqueous dyebath containing 20% o.w.f. of Kiwaron Polyester Black EX-FR (adisperse dye, made by Kiwa Kagaku K.K.), 10% o.w.f. of Remazol Black B and 0.5 g/l of acetic acid (90%), under the following conditions.

Heating-up time—60 minutes
Dyeing temperature—120° C.
Dyeing time—60 minutes
Liquor ratio—50:1

After cooling, the dyed fabric was soaped at 98° C. for 20 minutes in an aqueous bath containing 1 g/l of Sandet G-900, rinsed and dried. Thus, a black dyed fabric was obtained.

The dyed fabric was then cut into two pieces and the respective fabrics were printed with a color discharge printing paste and a discharge printing paste having the following compositions.

| Color discharge printing paste: | |
|---|---|
| Solophenyl Brilliant Blue BL (a direct dye of C.I. Direct Blue 106, made by Ciba-Geigy A.G.) | 2 parts by weight |
| Dianix Blue BGFS (a disperse dye of C.I. Disperse Blue 113, made by Mitsubishi Kasei K.K.) | 3 parts by weight |
| Stannous chloride | 10 parts by weight |
| Terryl Carrier DPL (a carrier based on ethyleneoxide adduct of p-phenylphenol, made by Meisei Kagaku K.K.) | 5 parts by weight |
| Meypro Gum NP (a 15% aqueous solution) | 60 parts by weight |
| Water | 20 parts by weight |
| Total | 100 parts by weight |

| White discharge printing paste: | |
|---|---|
| Decroline Soluble Conc. | 30 parts by weight |
| Terryl Carrier DPL | 5 parts by weight |
| Meypro Gum NP (a 15% aqueous solution) | 60 parts by weight |
| Water | 5 parts by weight |
| Total 100 parts by weight | |

The printed fabrics were dried at 80° C. for 10 minutes and, then, steamed at 130° C. for 30 minutes in a high-pressure steamer. The fabrics were then rinsed, soaped at 60° C. for 15 minutes in water containing 1 g/l of Sandet G-900, rinsed and dried. Thus, two printings respectively having clear blue and white patterns on the black back grounds were obtained.

The black area of the color discharge printed fabric had a light fastness of class 5 and the blue area had a light fastness of class 4. The washing fastness was class 5 in color change in the black area and was class 3 in color change the blue area.

EXAMPLE 4

A knitted fabric made from a spun yarn of a blend of acrylic fibers dyeable with an acid dye and ramie fibers (60:40) was padded to a pick-up of 70%, using an aqueous solution of 100 g/l of 2-hydroxy-3-methacryloxypropyl-trimethylammonium chloride and 1 g/l of ammonium persulfate. The fabric was then steamed at 105° C. for 3 minutes and soaped at 60° C. for 20 minutes in water containing 1 g/l of Sandet G-900 to remove the unreacted substances.

The weight increase of the fabric measured as in Example 1 was 2.8%. When a knitted fabric made from a spun yarn of acrylic fibers dyeable with an acid dye was treated was mentioned above, no weight increase was observed.

Then, the treated blend fabric was dyed, using an aqueous dyebath containing 1% o.w.f. of Kayanol Milling Yellow O (an acid dye of C.I. Acid Yellow 38, made by Nippon Kayaku K.K.), 0.1% o.w.f. of Kayanol Milling Red RS (an acid dye of C.I. Acid Red 114, made by Nippon Kayaku K.K.) and 1 g/l of acetic acid (90%), under the following conditions.

Heating-up time—30 minutes
Dyeing temperature—98° C.
Dyeing time—30 minutes
Liquor ratio—50:1

After cooling, the orange dyed fabric was soaped at 60° C. for 20 minutes in water containing 1 g/l of Sandet G-900, rinsed and dried.

The dyed fabric was then printed with a color discharge printing paste having the following composition.

| | |
|---|---|
| Solophenyl Brilliant Blue BL | 2 parts by weight |
| Superlight SZ | 10 parts by weight |
| Glyecine PFD (a carrier for acrylic fibers based on dicyanoethyl formamide: made by Bayer A.G.) | $HCON\begin{matrix}CH_2CH_2CN\\CH_2CH_2CN\end{matrix}$ |
| Meypro Gum NP (a 15% aqueous solution) | 5 parts by weight |
| Water | 60 parts by weight |
| Total | 23 parts by weight<br>100 parts by weight |

The printed fabric was dried at 80° C. for 10 minutes and steamed at 105° C. for 30 minutes. The fabric was then rinsed and soaped at 60° C. for 15 minutes in water containing 1 g/l of Sandet G-900. A printing having a blue pattern on the orange background was obtained.

The orange area of the printed fabric had a light fastness of class 3 and the blue area had a light fastness of class 4. The washing fastness was class 4 in color change in the orange area and was class 3 in color change in the blue area.

EXAMPLE 5

A musline fabric of a wood/cotton (60/40) blend was padded to a pick-up of 60%, using an aqueous solution of 150 g/l of 2-hydroxy-3-methacryloxypropyl-trimethylammonium chloride and 1 g/l of ammonium persulfate. The fabric was then steamed at 100° C. for 2 minutes and soaped at 60° C. for 20 minutes in water containing 1 g/l of Sandet G-900 to remove the unreacted substances. The weight increase of the treated fabric measured as in Example 1 was 2.5%.

When a wool muslin fabric was treated as mentioned above, no weight increase was observed.

Then, the treated blend fabric was dyed, using an aqueous dyebath containing 10% o.w.f. of Remazol Black B and 2% o.w.f. of formic acid, under the following conditions.

Heating-up time—30 minutes
Dyeing temperature—98° C.
Dyeing time—60 minutes
Liquor ratio—50:1

After cooling, the black dyed fabric was soaped at 60° C. for 20 minutes in water containing 1 g/l of Sandet G-900, rinsed and dried.

The dyed fabric was then printed with a color discharge printing paste of the following composition.

| | |
|---|---|
| Kayaku Brilliant Flavine FF (an acid dye of C.I. Acid Yellow 7:1, made by Nippon Kayaku K.K.) | 2 parts by weight |
| Superlight SZ | 10 parts by weight |
| Meypro Gum NP (a 15% aqueous solution) | 60 parts by weight |
| Water | 28 parts by weight |
| Total | 100 parts by weight |

The printed fabric was dried at 80° C. for 10 minutes and steamed at 100° C. for 30 minutes. The fabric was then rinsed and soaped at 60° C. for 15 minutes in water containing 1 g/l of Sandet G-900. A printing having a yellow pattern on the black background was obtained.

The black area of the printed fabric had a light fastness of class 4 and the yellow area had a light fastness of class 3. The washing fastness was class 4 in color change in the black area and was class 3 in color change in the yellow area.

What is claimed is:

1. A process for discharge printing a fabric of natural cellulosic fibers, comprising subjecting the fabric of natural cellulosic fibers having a polymer of a monomer containing a quarternary amine group dispersed therein with no phase separation to discharge printing.

2. A process according to claim 1, wherein the quarternary amine groups are contained in an amount equal to 10 to 800 milliequivalents per 1 Kg of the cellulosic fibers.

3. A process according to claim 1, wherein the polymer of the monomer containing a quarternary amine group is an addition polymer.

4. A process for discharge printing a fabric of cellulosic fibers, which comprises, in advance of the discharge printing, impregnating a monomer containing a quarternary amine group into a cellulosic fiber and polymerizing the monomer in the fiber.

5. A process according to claim 4, wherein the monomer containing a quarternary amine group is water soluble.

6. A process according to claim 4, wherein the monomer containing a quarternary amine group is an addition polymerizing monomer.

7. A process according to claim 4, wherein the polymerization of the monomer containing a quarternary amine group is carried out by heating the fiber in saturated steam.

8. A process for discharge printing a fabric of a blend of synthetic fibers dyeable with an anionic or disperse dye and cellulosic fibers, which comprises impregnating a monomer containing a quarternary amine group into the fabric, polymerizing the monomer in the fabric and, then, subjecting the fabric to discharge printing.

9. A process according to claim 8, wherein the synthetic fibers dyeable with an anionic or disperse dye are polyester fibers.

* * * * *